US008439124B2

(12) United States Patent
Braddock

(10) Patent No.: US 8,439,124 B2
(45) Date of Patent: May 14, 2013

(54) AIR INLET FOR PNEUMATIC POWER TOOL

(75) Inventor: C. Kerwin Braddock, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 1169 days.

(21) Appl. No.: 11/779,062

(22) Filed: Jul. 17, 2007

(65) Prior Publication Data

US 2009/0020300 A1 Jan. 22, 2009

(51) Int. Cl.
*B25C 1/04* (2006.01)

(52) U.S. Cl.
USPC ..... 173/1; 173/168; 173/171; 173/218; 173/219

(58) Field of Classification Search ..... 173/1, 168, 173/171, 218, 219
See application file for complete search history.

(56) References Cited

U.S. PATENT DOCUMENTS

| | | | | |
|---|---|---|---|---|
| 1,236,100 | A | 8/1917 | Nance | |
| 1,361,243 | A | 12/1920 | Fuson | |
| 3,421,631 | A | 1/1969 | Hirsch | |
| 3,559,764 | A * | 2/1971 | Wheeler, Jr. | 184/55.2 |
| 4,199,334 | A * | 4/1980 | Berkhoel | 55/304 |
| 4,243,111 | A * | 1/1981 | Willoughby et al. | 173/169 |
| 4,387,764 | A | 6/1983 | Lister | |
| 4,434,858 | A * | 3/1984 | Whitehouse | 173/177 |
| 4,612,116 | A * | 9/1986 | Hindman et al. | 210/333.1 |
| 4,721,166 | A * | 1/1988 | Clapp et al. | 173/177 |
| 4,844,176 | A * | 7/1989 | Podsobinski | 173/177 |
| 4,844,177 | A * | 7/1989 | Robinson et al. | 173/178 |
| 5,259,465 | A | 11/1993 | Mukoyama | |
| 5,609,028 | A | 3/1997 | Kakuda et al. | |
| 5,637,125 | A * | 6/1997 | Amada | 55/385.1 |
| 5,964,302 | A * | 10/1999 | Lin | 173/169 |
| 6,726,080 | B2 | 4/2004 | Hamada | |
| 2006/0086072 | A1 | 4/2006 | Ho et al. | |
| 2007/0137156 | A1 * | 6/2007 | da Costa et al. | 55/486 |

* cited by examiner

*Primary Examiner* — Brian D Nash
(74) *Attorney, Agent, or Firm* — Harness, Dickey & Pierce, P.L.C.

(57) ABSTRACT

A pneumatic power tool with a housing assembly, a pneumatic motor assembly, an output member, and a trigger assembly. The housing assembly has a body, a cap member and a gasket assembly. The body defines a motor cavity and an inlet manifold. The cap member defines an air inlet port. The gasket has a first portion being a band formed of a compressible material and a second portion formed of a porous material. The band of the first portion is sealingly abutted against the body and cap member. The pneumatic motor assembly is received in the motor cavity defined by the body. The output member is driven by the pneumatic motor assembly. The trigger assembly is coupled to the housing assembly and is operable for selectively operating the pneumatic motor assembly. Pressurized air received into the air inlet port is filtered by the second portion of the gasket assembly and flows into the inlet manifold when the pneumatic motor assembly is operated. A related method is also provided.

26 Claims, 4 Drawing Sheets

AIR INLET FOR PNEUMATIC POWER TOOL

INTRODUCTION

The present invention generally relates to pneumatic power tools and more particularly to a pneumatic power tool having a gasket assembly that sealingly engages mating portions of the pneumatic power tool and filters air that flows there through.

Many hand-held pneumatic power tools are provided with a screen in the air inlet port of the tool that is employed to coarsely filter the incoming air flow to prevent relatively large contaminants from entering the trigger or motor of the tool. The relatively small diameter of the air inlet port requires that the filter be correspondingly small and consequently the screen typically has a small surface area that can restrict air flow and thus degrade tool performance.

SUMMARY

In one form, the present teachings provide a pneumatic power tool with a housing assembly, a pneumatic motor assembly, an output member, and a trigger assembly. The housing assembly has a body, a cap member and a gasket assembly. The body defines a motor cavity and an inlet manifold. The cap member defines an air inlet port. The gasket has a first portion being a band formed of a compressible material and a second portion being a porous material coupled to an interior region of the band. The band of the first portion is sealingly abutted against the body and cap member. The pneumatic motor assembly is received in the motor cavity defined by the body. The output member is driven by the pneumatic motor assembly. The trigger assembly is coupled to the housing assembly and is operable for selectively operating the pneumatic motor assembly. Pressurized air received into the air inlet port is filtered by the second portion of the gasket assembly and flows into the inlet manifold when the pneumatic motor assembly is operated.

In another form, the present teachings provide a method that includes: providing a pneumatic power tool having a housing assembly, a pneumatic motor assembly housed by the housing assembly and a trigger assembly that is coupled to the housing assembly and operable for selectively operating the pneumatic motor assembly, the housing assembly including a body and a cap member, the body defining an inlet manifold, the cap member defining an air inlet port; positioning a gasket assembly between the cap member and the body, the gasket member including a seal portion and a porous portion that is coupled to the seal portion and disposed inwardly thereof; and securing the cap member and the gasket assembly to the body such that the seal portion sealingly engages the cap member and the body and the porous portion is disposed between the inlet port and the inlet manifold.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
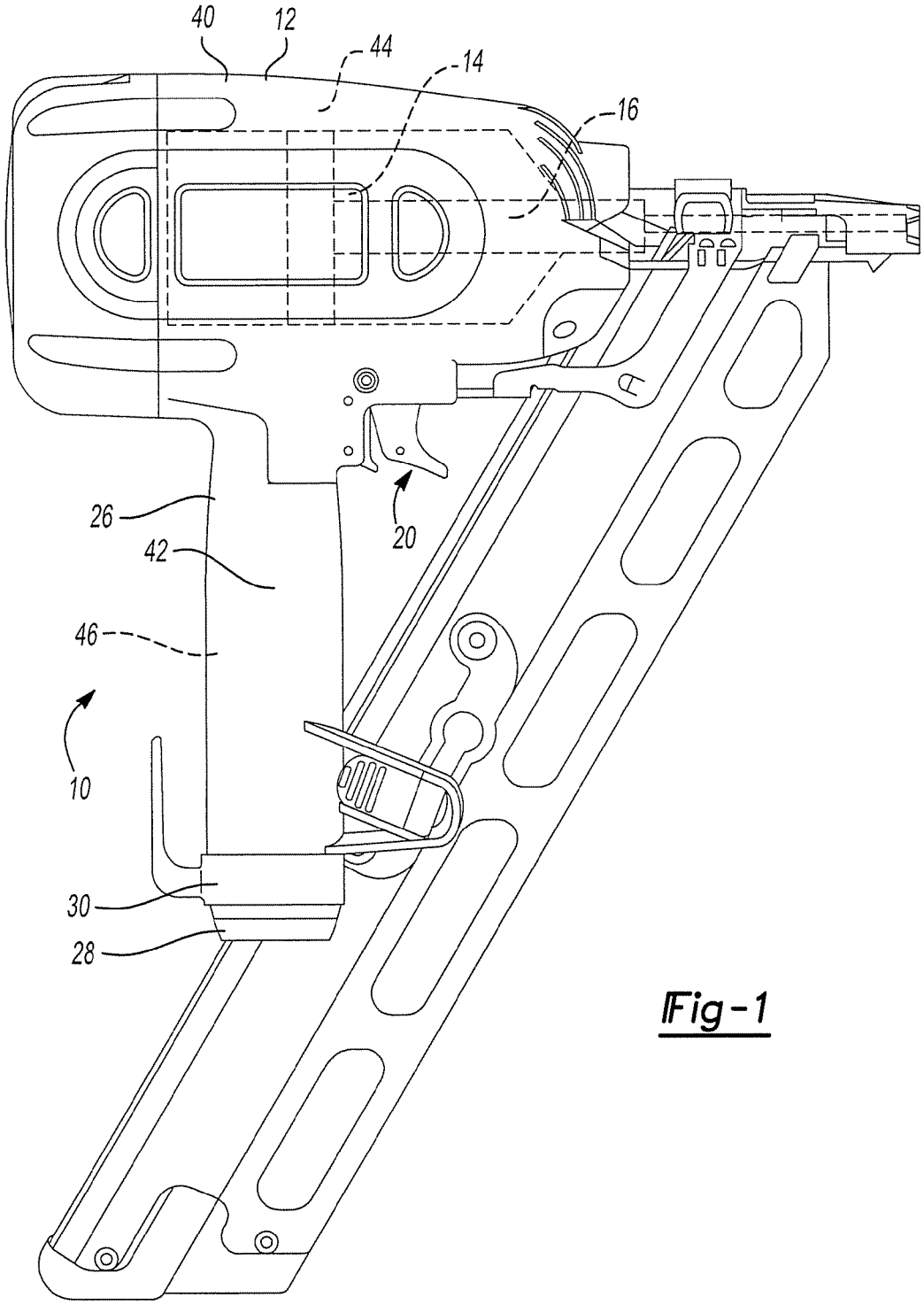
FIG. 1 is a perspective view of the right side of a tool constructed in accordance with the teachings of the present invention.
Figure 2:
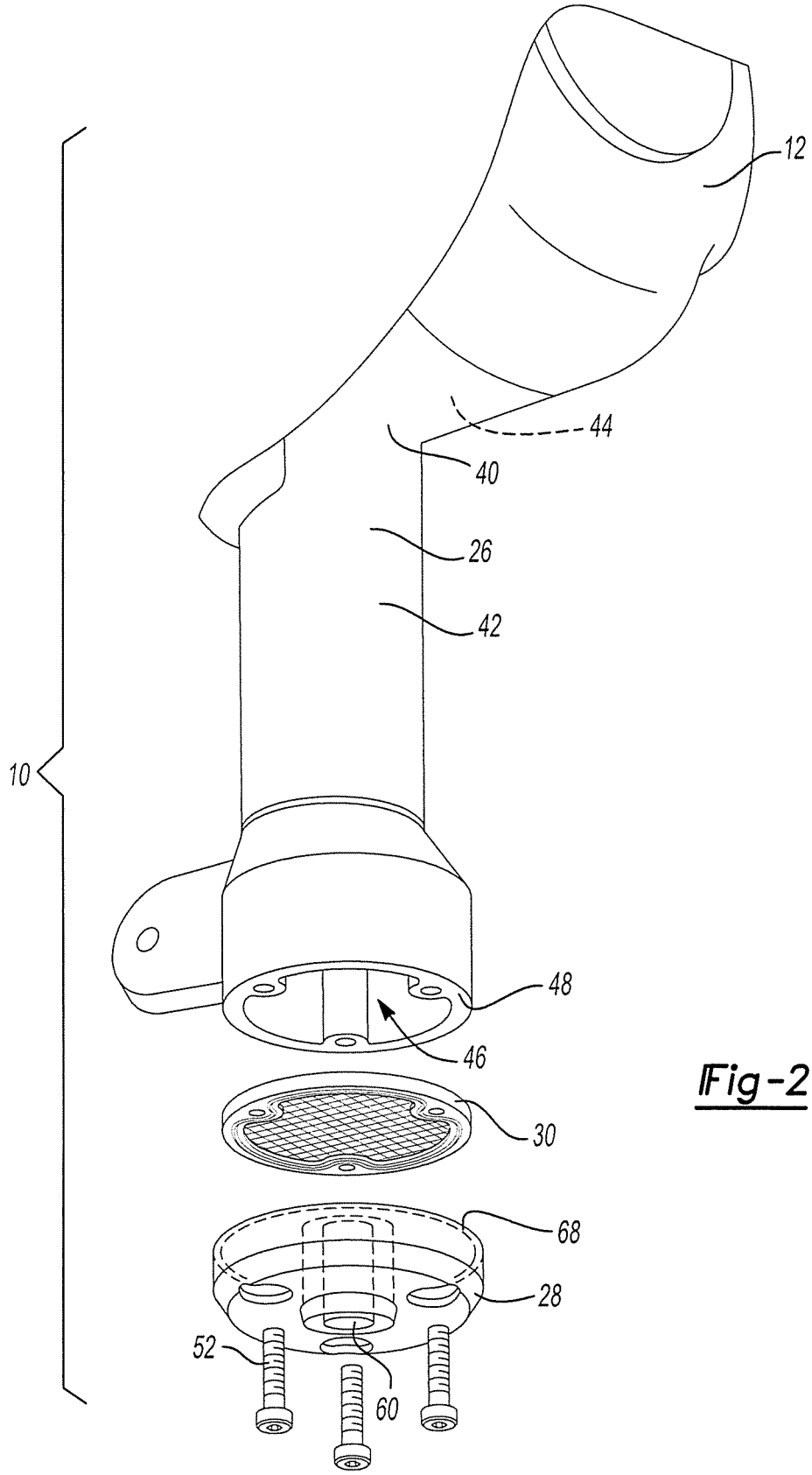
FIG. 2 is an exploded partial perspective view of a portion of the tool of FIG. 1 illustrating the body, gasket assembly and cap member in more detail.
Figure 3:
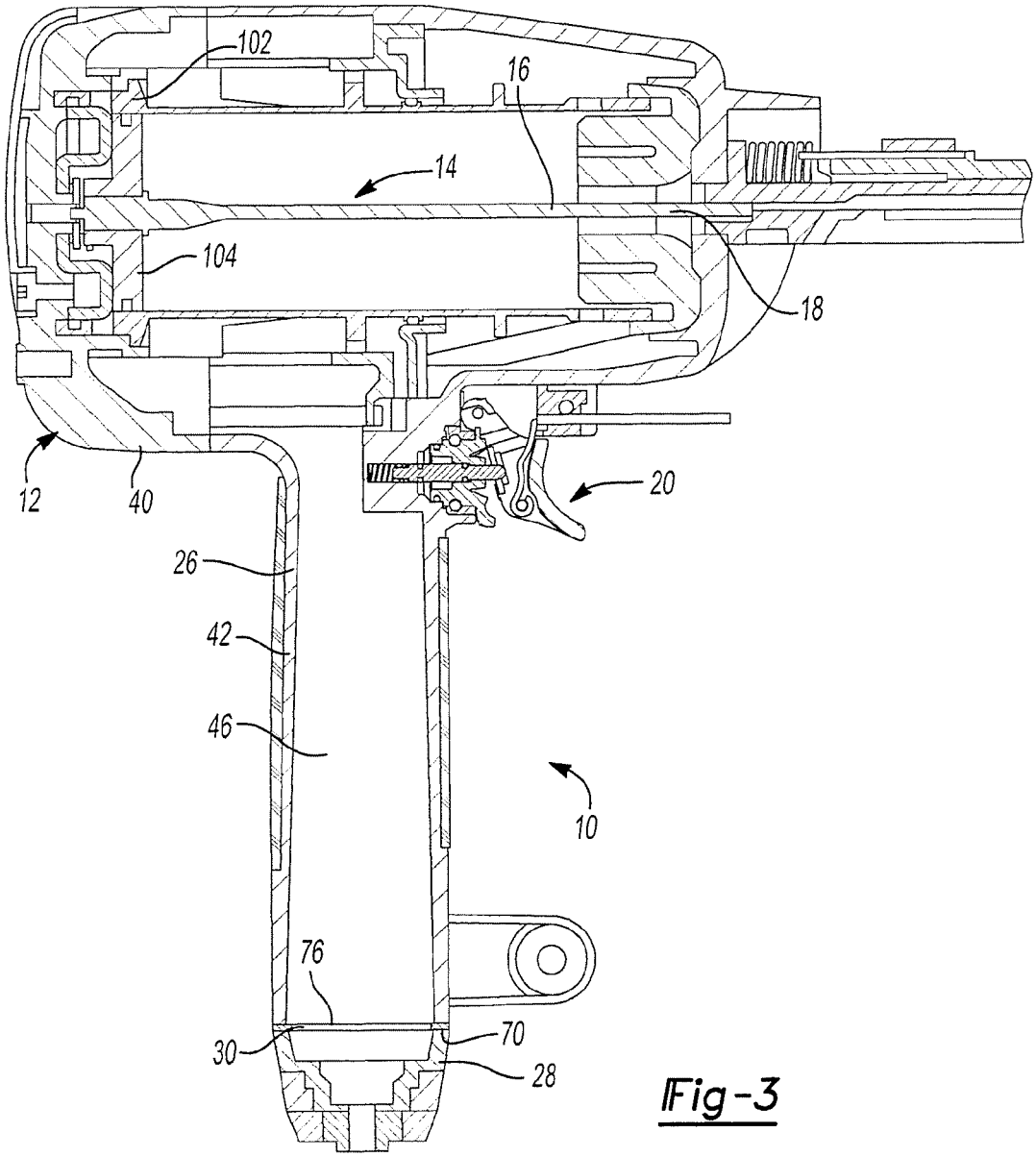
FIG. 3 is a cross-sectional side view of the portion of the tool depicted in FIG. 2 illustrating the body, gasket assembly and cap member in even greater detail.

With reference to FIGS. 1 through 3 of the drawings, a pneumatic tool constructed in accordance with the teachings of the present disclosure is generally indicated by reference numeral 10. The pneumatic tool 10 can include a housing assembly 12, a pneumatic motor assembly 14, an output member 16 such as a driver 18, and a trigger assembly 20. In the particular embodiment illustrated, the pneumatic tool 10 is a nailer, but it will be appreciated that the teachings of the present disclosure have applicability to other types of hand-held pneumatic tools, including those having a rotary, axial, reciprocating, oscillating and/or orbital output.

The housing assembly 12 can include a housing 26, a cap member 28 and a gasket assembly 30. With additional reference to FIGS. 2 and 3, the housing 26 can include a body 40 and a handle 42 that can be configured to permit an operator to manipulate and guide the pneumatic tool 10 in a desired manner. In the particular example illustrated, the body 40 can define a motor cavity 44, which can be configured to at least partially house the pneumatic motor assembly 14, while the handle 42 can define an inlet manifold 46 that can serve as a reservoir of compressed air that can be coupled in fluid connection to the motor assembly 14 and the trigger assembly 20. The proximal end of the handle 42 can be coupled to the body 40, while the distal end of the handle 42 can define a first sealing surface 48.

The cap member 28 can be removably coupled to the handle 42 in any appropriate manner, such as threaded fasteners 52, to close the open end of the inlet manifold 46. The cap 38 can define an air inlet port 60 and a second sealing surface 68. The air inlet port 60 can include a threaded connection 62, such as a female threaded connection, that can be employed to couple the pneumatic tool 10 to a source of compressed air (not shown).

Figure 4:
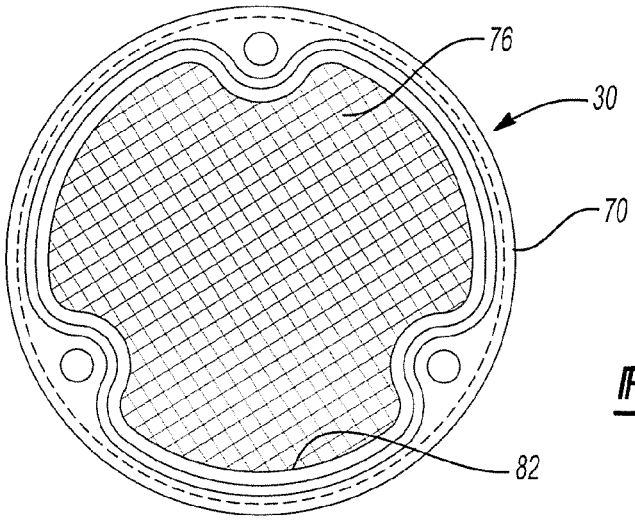
FIG. 4 is a front view of a gasket assembly constructed in accordance with the teachings of the present invention.

With reference to FIG. 4, the gasket assembly 30 can include a seal member 70 and a filter member 76 that can be sealingly coupled to the seal member 70 by any appropriate means, such as overmolding (i.e., overmolding the seal member 70 onto the filter member 76) or bonding. The seal member 70 can be formed of an appropriate material that is configured to sealingly engage the first and second sealing surfaces 48 and 68. The seal member 70 can be a band-shaped structure that defines an interior region 82.

The filter member 76 can be sealingly coupled to the seal member 70 and can extend across the entirety of the interior region 82. The filter member 76 can be formed of an appropriate material for filtering compressed air input to the pneumatic tool. A relatively coarse filter member 76 may be desirable in some situations and as such, the filtering material can be a screen or mesh that can be formed of metal, plastic or textile, for example. A relatively fine filter member 76 may be desirable in other situations and as such, the filter material can be a porous paper, ceramic, foam or plastic filter media element. It will be appreciated that combinations of materials may be employed to form the filter member 76. For example, the filter member 76 could be formed of discrete layers of progressively finer filter material.

The filter member 76 can be formed of a mesh of a suitable material (e.g., stainless steel, bronze, brass) and can have a desired mesh size, such as 30 mesh or higher. Alternately, the filter member 76 can be formed of a porous material, such as a filter paper, an open-cell foam, a ceramic or a sintered material, and can have a porosity that is suited to provide a desired degree of filtering while permitting an air flow of a desired mass-flow rate to flow there through.

In the particular example provided, the filter member 76 is formed of a wire mesh having an open area of about 30% and the seal member 70 is formed of a thermoplastic elastomer that is overmolded onto the filter member 76 and encapsulates and/or sealingly engages an outer portion of the filter member 76. In the configuration illustrated, the area of the filter member 76 through which air may flow is about 1.693 square inches, whereas the cross-sectional area of the housing assembly 12 where the gasket assembly 30 is located is about 2.345 square inches. As such, the ratio of the area of the flowable filter media to the cross-sectional area of the housing assembly 12 where the gasket assembly 30 is located is about 0.72.

Returning to FIG. 3, the pneumatic motor assembly 14, the output member 16 and the trigger assembly 20 are at least partially contained in the housing assembly 12. As those of ordinary skill in the art will appreciate, the pneumatic motor assembly 14, the output member 16 and the trigger assembly 20 can be constructed in any appropriate manner. For example, the pneumatic motor assembly 14, the output member 16 and the trigger assembly 20 can be constructed in the manner described in commonly assigned U.S. Pat. No. 6,648,202 entitled "Pneumatic Fastening Tool" issued on Nov. 18, 2003, the description of which is hereby incorporated by reference as if fully set forth in detail herein.

In the particular example provided, the pneumatic motor assembly 14 includes a pneumatic cylinder 102 and a piston 104 that is fixed to the output member 16. The piston 104 can be movable between a retracted position and an extended position. The trigger assembly 20 can be coupled in fluid connection to the air inlet manifold 46 and can be employed to control the application of fluid pressure to the piston 104 to cause the piston 104 to move between the retracted and extended positions. When the trigger assembly 20 is selectively engaged by an operator to activate the pneumatic tool 10, pressurized fluid is applied to the piston 104 to thereby propel the piston 104 in a linear direction along the axis of the pneumatic cylinder 102 to the extended position. As the piston 104 is fixed to the output member 16, translation of the piston 104 to the extended position permits the output member 16 to drive a fastener (not shown), such as a nail or staple, into a workpiece.

Figure 5:
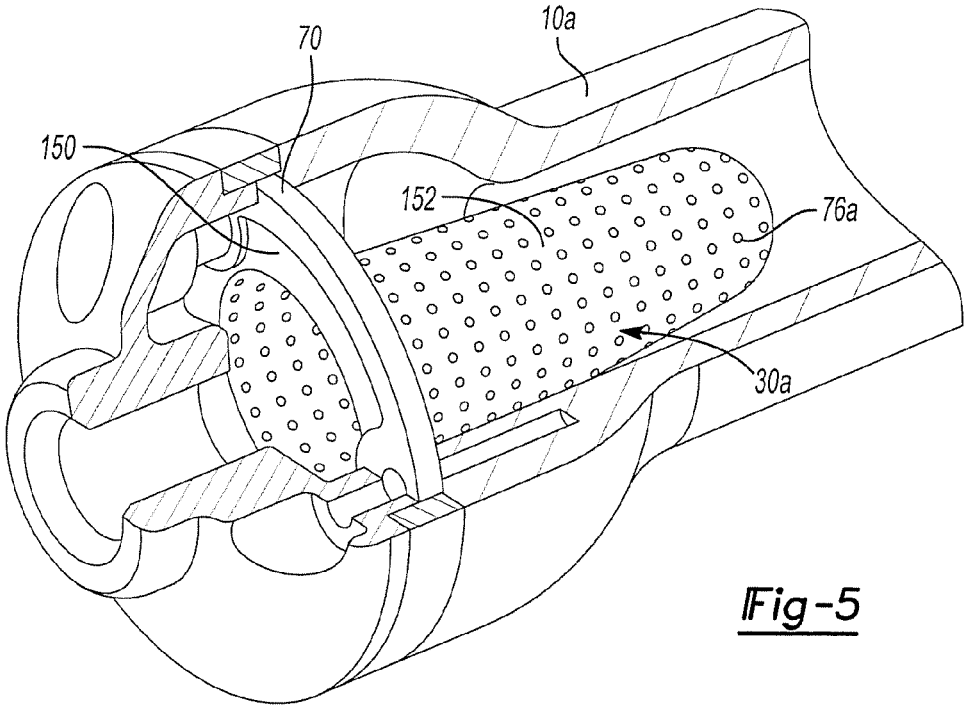
FIG. 5 is a partially broken-away perspective view of a portion of another pneumatic tool constructed in accordance with the teachings of the present disclosure.

While the pneumatic tool 10 has been illustrated and described herein as including a gasket assembly 30 with a filter member 76 that is formed of a material with substantially planar opposite surfaces, those of skill in the art will appreciate that the invention, in its broadest aspects, may be constructed somewhat differently. For example, a pneumatic tool 10*a* having a gasket assembly 30*a* is shown in FIG. 5. In this example, the gasket assembly 30*a* can include the seal member 70 and a filter member 76*a* having a flange portion 150 and a three-dimensionally contoured body portion 152 to provide the gasket assembly 30*a* with an effective filtering area (i.e., the surface area of the filter member 76) that is greater than an interior area of the pneumatic tool 10*a* at a location where the seal member 70 contacts a sealing surface (e.g., the first sealing surface 48 (FIG. 3). Preferably the effective filtering area is at least 25% greater than the interior area. More preferably, the effective filtering area is at least 40% greater than the interior area and still more preferably, the effective area is at least 80% greater than the interior area. The filter member 76 of the gasket assembly 30*a* has a longitudinal cross-section that is at least partially defined by a parabola in the particular example provided. Those of skill in the art will appreciate from this disclosure that the particular three-dimensional shape employed may include other desired shapes, including shapes that are at least partially conical and/or frustoconical. The pneumatic tool 10*a* can be otherwise similar to the pneumatic tool 10 (FIG. 1).

Aside from the three-dimensional contoured shape of the body portion 152, the gasket assembly 30*a* can be generally similar to the gasket assembly 30 (FIG. 4). In this regard, the filter member 76*a* can be sealingly coupled to the seal member 70 by any appropriate means, such as overmolding (e.g., overmolding the seal member 70 onto the filter member 76*a*) or bonding. Furthermore, the filter member 76*a* can be formed of any appropriate filter media or combination of filter media. Those of skill in the art will appreciate that the contoured body portion 152 can have a large filter surface area (relative to a surface area of the gasket assembly 30 (FIG. 4)) so as to provide increased air flow capacity and/or increased life expectancy of the filter. In the particular example provided, the area of the filter member 76*a* through which air may flow is about 4.700 square inches, whereas the cross-sectional area of the housing assembly 12 where the gasket assembly 30*a* is located is about 2.345 square inches. As such, the ratio of the area of the flowable filter media to the cross-sectional area of the housing assembly 12 where the gasket assembly 30*a* is located is about 2.00.

In the particular example provided, the flange portion 150 and the contoured body portion 152 are unitarily formed from a plastic material such that the flange portion 150 is non-porous while the contoured body portion 152 is porous. Those of ordinary skill will appreciate that one or more layers (not shown) of a filtering material may be layered onto contoured body portion 152 to progressively filter the air that is passed therethrough.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

What is claimed is:

1. A pneumatic power tool comprising:

a housing assembly having a body, a cap member and a gasket assembly, the body defining a motor cavity and an inlet manifold, the cap member defining an air inlet port, the gasket assembly having a first portion and a second portion, the first portion being a band that is formed of a compressible material, the band being sealingly abutted against the body and cap member, the second portion being coupled to an interior region of the band and being formed of a porous material;

a pneumatic motor assembly received in the motor cavity;

an output member driven by the pneumatic motor assembly; and a trigger assembly coupled to the housing assembly and operable for selectively operating the pneumatic motor assembly;

whereby pressurized air received into the air inlet port is filtered by the second portion of the gasket assembly and flows into the inlet manifold when the pneumatic motor assembly is operated.

2. The pneumatic power tool of claim 1, wherein the output member is a driver that is adapted to drive at least one of a nail and a staple.

3. The pneumatic power tool of claim 1, wherein the compressible material is a resilient material.

4. The pneumatic power tool of claim 3, wherein the resilient material is an elastomer.

5. The pneumatic power tool of claim 4, wherein the elastomer is overmolded onto the porous material.

6. The pneumatic power tool of claim 1, wherein the porous material is a screen.

7. The pneumatic power tool of claim 6, wherein the screen is a wire mesh.

8. The pneumatic power tool of claim 1, wherein the porous material is a filter media selected from a group consisting of paper, foam, ceramic, and combinations thereof.

9. The pneumatic power tool of claim 1, wherein the porous material is a mesh with about 30% open area.

10. The pneumatic power tool of claim 1, wherein the body further defines a handle and the inlet manifold is disposed within the handle.

11. The pneumatic power tool of claim 1, wherein an interior area is defined by the body at a location where the band is sealingly abutted against the body and wherein the second portion of the gasket assembly has a surface area that is greater than the interior area.

12. The pneumatic power tool of claim 11, wherein the surface area of the second portion of the gasket assembly is at least 25% greater than the interior area.

13. The pneumatic power tool of claim 12, wherein the surface area of the second portion of the gasket assembly is at least 40% greater than the interior area.

14. The pneumatic power tool of claim 13, wherein the surface area of the second portion of the gasket assembly is at least 80% greater than the interior area.

15. The pneumatic power tool of claim 11, wherein at least a portion of a longitudinal cross-section of the gasket assembly is generally parabolic in shape.

16. A method comprising:

providing a pneumatic power tool having a housing assembly, a pneumatic motor assembly housed by the housing assembly and a trigger assembly that is coupled to the housing assembly and operable for selectively operating the pneumatic motor assembly, the housing assembly including a body and a cap member, the body defining an inlet manifold, the cap member defining an air inlet port;

positioning a gasket between the cap member and the body, the gasket including a seal portion and a porous portion that is coupled to the seal portion and disposed inwardly thereof;

securing the cap member and the gasket to the body such that the seal portion sealingly engages the cap member and the body and the porous portion is disposed between the inlet port and the inlet manifold.

17. The method of claim 16, wherein prior to positioning the gasket the method includes decoupling the cap member from the body.

18. A pneumatic power tool comprising:

a housing assembly having a body, a cap member and a gasket, the body defining a motor cavity and an inlet manifold, the cap member defining an air inlet port, the gasket having a seal portion and a filter portion that is fixedly coupled to the seal portion, the seal portion sealingly engaging the body and the cap member, the filter portion being a porous structure that cooperates with the seal portion, the cap member and the body to form a barrier between the air inlet port from the inlet manifold;

a pneumatic motor assembly received in the motor cavity;

an output member driven by the pneumatic motor assembly; and a trigger assembly coupled to the housing assembly and operable for selectively operating the pneumatic motor assembly;

wherein the barrier inhibits particles that are greater than a predetermined size from being transmitted from the air inlet to the inlet manifold.

19. The pneumatic power tool of claim 18, wherein the filter portion is selected from a group of filter media consisting of screens, foams, papers, ceramics and combinations thereof.

20. The pneumatic power tool of claim 18, wherein the output member is a driver that is adapted to drive a nail or a staple.

21. The pneumatic power tool of claim 18, wherein the body further defines a handle and the inlet manifold is disposed within the handle.

22. The pneumatic power tool of claim 18, wherein an interior area is defined by the body at a location where the seal portion is sealingly abutted against the body and wherein the second portion of the gasket has a surface area that is greater than the interior area.

23. The pneumatic power tool of claim 22, wherein the surface area of the second portion of the gasket is at least 25% greater than the interior area.

24. The pneumatic power tool of claim 23, wherein the surface area of the second portion of the gasket is at least 40% greater than the interior area.

25. The pneumatic power tool of claim 24, wherein the surface area of the second portion of the gasket is at least 80% greater than the interior area.

26. The pneumatic power tool of claim 22, wherein at least a portion of a longitudinal cross-section of the gasket is generally parabolic in shape.

* * * * *